US005112045A

United States Patent [19]

Mason et al.

[11] Patent Number: 5,112,045

[45] Date of Patent: May 12, 1992

[54] KINESTHETIC DIAGNOSTIC AND REHABILITATION DEVICE

[75] Inventors: Jeffrey T. Mason, Escondido; Bradley R. Mason, Olivenhain; Mark E. Howard, El Cajon, all of Calif.

[73] Assignee: Breg, Inc., Vista, Calif.

[21] Appl. No.: 578,509

[22] Filed: Sep. 5, 1990

[51] Int. Cl.[5] ..... A63B 5/00

[52] U.S. Cl. ..... 482/9; 128/25 R; 482/77; 482/112; 482/146; 482/142; 482/901

[58] Field of Search ..... 272/144, 146, 96, 133, 272/111; 128/25 R; 297/DIG. 3, DIG. 5

[56] References Cited

U.S. PATENT DOCUMENTS

| | | | |
|---|---|---|---|
| 2,978,243 | 4/1961 | Gabrielson | 272/146 |
| 3,485,240 | 12/1969 | Fountain | 128/33 |
| 3,859,736 | 1/1975 | Hill | 272/144 |
| 4,516,768 | 5/1985 | Gallaro | 272/144 |
| 4,548,289 | 10/1985 | Mechling | 128/774 |
| 4,609,190 | 9/1986 | Brentham | 272/144 |
| 4,817,950 | 4/1989 | Goo | 272/146 |
| 4,944,309 | 7/1990 | Mechling | 128/782 |

FOREIGN PATENT DOCUMENTS

| | | | |
|---|---|---|---|
| 940953 | 1/1974 | Canada | 272/146 |
| 0134047 | 3/1983 | European Pat. Off. | 272/146 |
| 2597758 | 4/1986 | France | 272/144 |

*Primary Examiner*—Robert Bahr
*Assistant Examiner*—J. Donnelly
*Attorney, Agent, or Firm*—Nydegger & Associates

[57] ABSTRACT

A kinesthetic diagnostic and rehabilitation device enables the user to measure the extent of kinesthetic impairment resulting from a bodily injury, particularly an injury to the lower limbs, and also enables the user to rehabilitate the injury. The device is provided with a rigid platform resting atop an unstable support. The ability of the patient to maintain a fixed position on the platform as a function of the instability of the support enables quantification of the patient's kinesthetic impairment. The device further provides rehabilitative exercise.

14 Claims, 1 Drawing Sheet

KINESTHETIC DIAGNOSTIC AND REHABILITATION DEVICE

BACKGROUND OF THE INVENTION

1. Technical Field

The invention relates to an apparatus for diagnosing and rehabilitating bodily injuries and more particularly to an apparatus for diagnosing and rehabilitating kinesthetic impairment resulting from bodily injuries.

2. Background Information

Skeletal or tissue injuries to the human body are commonly accompanied by kinesthetic impairment. Kinesthesis is a term which generally encompasses an individual's perception of the movement and position of his body in space. The perception derives from sensory feedback from the joints or soft tissue including muscles, ligaments and tendons. Kinesthetic impairment is especially acute when it impacts the lower limbs because the impairment may diminish an individual's balance or mobility, particularly in athletic endeavors.

Diagnosis of the extent or rehabilitative progress of skeletal or soft tissue injuries is commonly measured by determining the range of motion or degree of strength in the region of the injury. However, these criteria do not always adequately characterize the injury because they do not measure kinesthetic impairment. Similarly, exercises designed to rehabilitate the injury commonly focus on restoring strength and range of motion to the region of the injury with little or no specificity to restoring kinesthetic function. Thus, although an injury may appear fully rehabilitated based on an evaluation of the strength and range of motion in the region of the injury, the patient may not have experienced full kinesthetic rehabilitation.

As such, a diagnostic device is needed which enables one to diagnose the extent of initial kinesthetic impairment from a bodily injury and to diagnose the subsequent degree of kinesthetic rehabilitation resulting from treatment of the injury. Further, a treatment device is needed which advances kinesthetic rehabilitation of the injury.

SUMMARY OF THE INVENTION

The kinesthetic diagnostic and rehabilitation device of the present invention is a rigid platform resting atop an elastically deformable support member. A patient stands on the platform and balances or performs other exercises on the platform which require the patient to work against the instability of the support member. The performance of the exercises enables diagnosis and rehabilitation of any kinesthetic impairment which the patient is experiencing.

DESCRIPTION OF PREFERRED EMBODIMENTS

Figure 1:
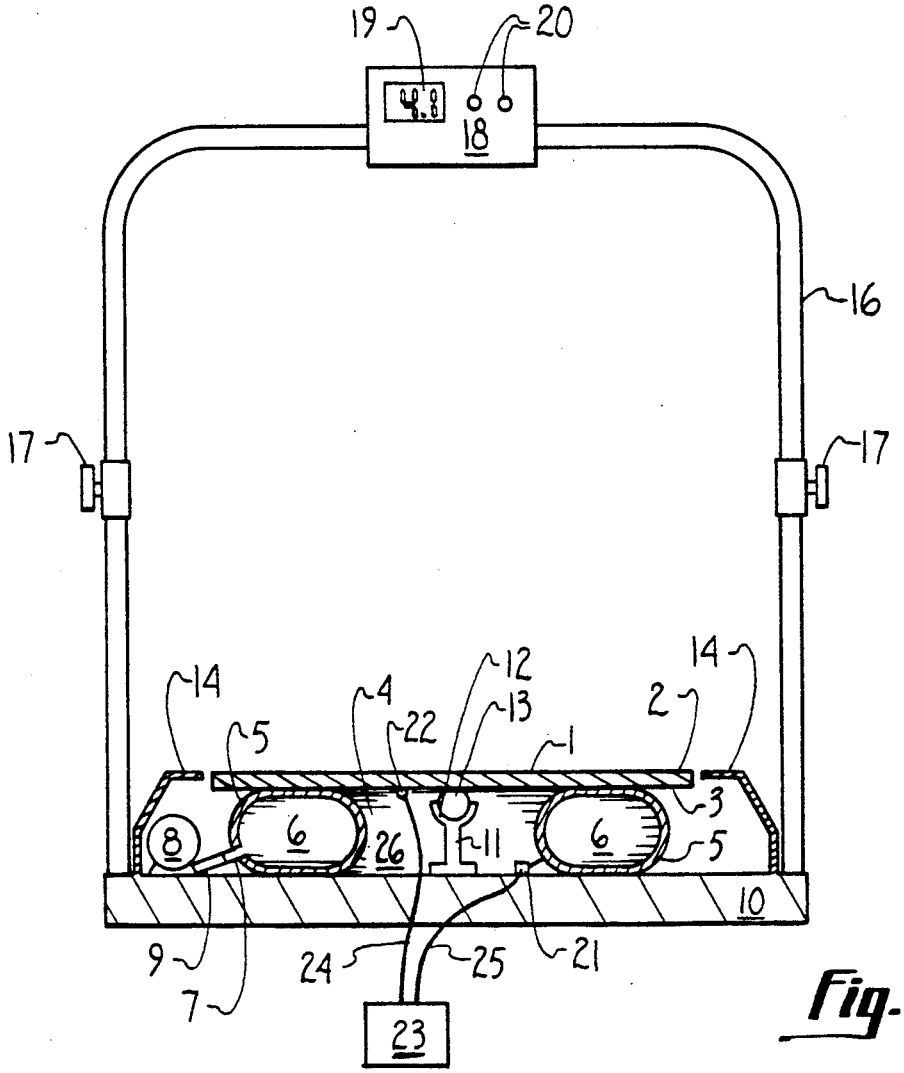
FIG. 1 is a cross-sectional side view of the device in communication with a remote computer.
Figure 2:
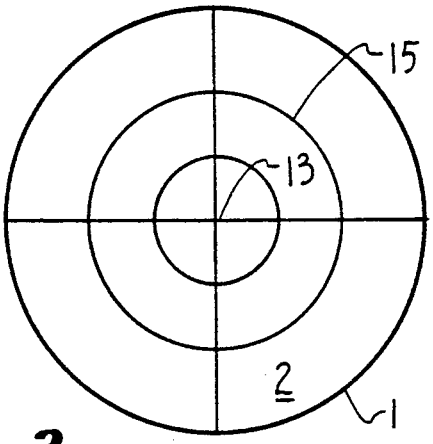
FIG. 2 is a top view of the standing surface.
Figure 3:
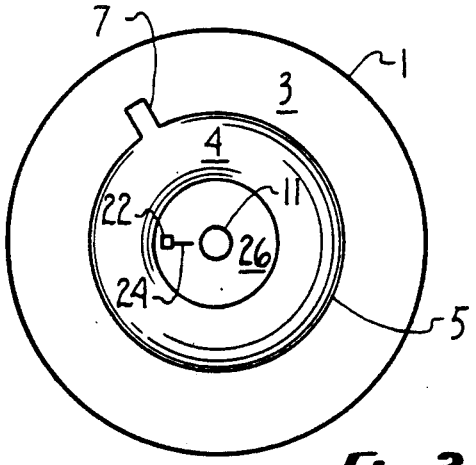
FIG. 3 is a bottom view of the platform and support.

A preferred embodiment of the present invention is set forth in FIGS. 1-3. The invention is described below with reference to these figures.

The kinesthetic diagnostic and rehabilitation device has a rigid platform 1 which rests atop an elastically deformable support member 4. The rigid platform 1 is substantially inelastic relative to the support member 4. The platform 1 has a planar configuration with a top surface 2 and a bottom surface 3. The bottom surface 3 of the platform 1 abuts the top of the support member 4. The platform 1 is preferably formed in the shape of a disk.

The elastically deformable support member 4 beneath the platform 1 can be an adjustable-stability member, such as the preferred fluid-containing bladder 4 shown in the embodiment of FIG. 1. According to another embodiment, the elastically deformable support member is a unitary member made from a continuous elastic material having a fixed stability. For example, the continuous elastic material can be a foamed plastic.

The fluid-containing bladder 4 of the preferred embodiment has a skin 5 fabricated from rubber or a similar elastomeric material. The fluid contained in the interior 6 of the skin 5 is preferably a pressurized gas such as air. The bladder 4 has a valve 7 which enables the user to adjust the pressure of the air in the bladder 4. The valve 7 provides for either inflating the bladder 4 by adding air to it to increase the air pressure therein or deflating the bladder 4 by withdrawing air from it to decrease the air pressure therein.

Adjustment of the air pressure in the bladder 4 controls the elasticity or firmness of the bladder 4 and correspondingly controls its stability as a support for the platform 1. As the pressure in the bladder 4 is increased, the support becomes less elastic and more firm, and consequently more stable. Conversely, as the pressure in the bladder 4 is decreased, the support becomes more elastic and less firm, and consequently less stable. A pressure adjustment means may be provided, such as a manual or electric pump 8, which is in fluid communication with the bladder 4 via line 9 feeding into the valve 7. The electric pump 8 may be controlled by the user in a manner described below.

The top surface 2 to the platform 1 is the standing surface for a patient on the device. The patient uses the device while standing with either one or both feet on the standing surface 2. Guide markings 15 can be provided on the standing surface 2 for correct placement of the patient's feet.

The kinesthetic device may be further provided with a pivot means 11 which provides a fixed point about which the platform 1 can pivot when the patient is standing on it. The preferred pivot means 11 is a rigid post 11 flexibly attached to the bottom surface 3 of the platform 1 by means of a flexible joint. The preferred flexible joint is a ball joint 12 providing a pivot point about which the platform 1 is free to move in a vertical direction. However, the ball joint 12 secures the platform 1 from horizontal drift by preventing substantial movement of the platform 1 in the horizontal direction.

A base 10 can be positioned beneath the bladder 4. The base 10 abuts the bottom of the bladder 4 and supports it. The base 10 can also serve to maintain the bladder 4 in a fixed position beneath the platform 1.

The elastically deformable support member 4 of the present invention is preferably formed in the shape of a toroid. The support member 4 is positioned concentrically beneath the platform 1 and the pivot means 11 is positioned in the central opening 26 of the toroid. The pivot means 11 can be secured by attachment to the base 10

The platform 1 and bladder 4 are preferably sized such that the surface area of the platform 1 is greater than the area of contact between the bladder 4 and the bottom surface 3 of the platform 1. In the configuration of FIG. 1, the most preferred toroid-shaped support member 4 has a diameter less than that of the platform 1. The diameter of the platform 1 is preferably between about 30 cm and about 91 cm, and more preferably between about 46 cm and about 76 cm. The support member 4 preferably has a diameter which is about 50% to about 70% less than that of the platform 1.

The device can be further provided with a rail 16 which is positioned at a height just higher than that of the patient's waistline when standing on the balance surface. The rail 16 enables the patient to use his hands when mounting and dismounting the standing surface 2 or to catch himself with his hands should he lose his balance while on the standing surface 2. The rail 16 may be provided with conventional adjustment means 17 to raise or lower the height of the rail 16 for patients of different heights. Such adjustment means are well known to those skilled in the art. The rails 16 may be attached to the base 10. In addition, a shroud 14 may be provided around the perimeter of the platform 1, which is an integral part of the base 10 and screens the equipment beneath the platform 1 from the user.

To use the device, the patient stands on the standing surface 2 as described above to perform any number of exercises. A therapist can specify the exact positioning of the patient's foot or feet on the surface 2 depending on the nature of the exercise to be performed. Among the possible exercises, the patient can be required to pivot the platform 1 in a specific pattern, such as a figure eight, perform ranges of motion on the platform 1, or simply balance the platform 1 in a stationary position. The pivot 11 and bladder 4 provide varying degrees of stabilizing support beneath the platform 1 to assist the patient in maintaining his position on the standing surface 2.

The air pressure in the bladder 4 can be varied to control the degree of stability which the bladder 4 provides the platform 1. At a high pressure, it is relatively easy for the patient to maintain a position on the standing surface 2 while exercising. At decreasing air pressures in the bladder 4, it becomes increasingly difficult for the patient to maintain a position on the surface 2.

The device may have a bladder pressure control unit to facilitate use of the device. The control unit comprises a panel 18 affixed to the rail having a pressure display 19 and pressure control keys 20. A pressure transducer 21 communicates the pressure in the bladder 4 to the display 19. The patient can raise or lower the pressure in the bladder 4 simply by depressing the appropriate control key 20 which instructs activation of the pump 8 or withdrawal of air from the bladder 4. The circuitry enabling these functions is conventional to one skilled in the art.

The device is used for diagnostic purposes by inflating the bladder 4 to a high pressure which enables the patient to easily maintain a position on the standing surface 2. The pressure is then incrementally decreased to determine the point at which the patient can no longer maintain a given position on the surface 2. This pressure value provides a relative basis for quantifying the initial extent of kinesthetic impairment. Progress of the rehabilitation is quantified by measuring the decreasing pressures at which the patient can maintain the position over the period of rehabilitation.

The diagnostic function of the device may be further enhanced by providing at least one inclinometer 22 on the bottom 3 of the platform 1. The at least one inclinometer 22 is in electrical communication with a computer 23, which may be remote from the device, via line 24. The inclinometer 22 sends data to the computer 23 which indicates the instantaneous inclination of the platform 1 over time while the patient is exercising. The pressure transducer 21 also communicates pressure variations in the bladder 4 as a function of time to the computer 23 via line 25. The computer 23 can process this data in a manner which provides meaningful diagnostic information to a patient or therapist.

In addition to a diagnostic function, the device has a rehabilitative function as an exercise device. The patient is positioned on the standing surface 2 with the bladder 4 at a predetermined air pressure. The predetermined pressure of the bladder 4 is preferably a pressure which at least somewhat destabilizes the platform and which causes the patient to work kinesthetically in maintaining the position on the surface 2 to offset the instability of the bladder 4. The patient is required to maintain one or more given positions on the surface 2 throughout an exercise regimen.

The pressure range in which the bladder 4 is operable is between about 0 and about 69 kPa and preferably between about 0 and about 41 kPa. A typical high pressure at which the platform 1 is relatively stable is about 41 kPa. The platform 1 is typically relatively unstable when the bladder 4 is at an intermediate pressure of about 21 kPa. The platform 1 is typically Very unstable when the bladder 4 is at a low pressure of about 0 kPa. It is understood that the above-recited typical pressure values are given only by way of example. These pressure values may not correspond to the recited levels of stability in all cases and are not to be construed as limiting the invention.

While the foregoing preferred embodiments of the invention have been described and shown, it is understood that alternatives and modifications, such as those suggested and others, may be made thereto and fall within the scope of the invention.

We claim:

1. An apparatus for diagnosing or rehabilitating kinesthetic impairment comprising:

a rigid disk-shaped platform having sufficient surface area for a user to stand thereon with at least one foot in continuous contact with said platform;

an elastically deformable fluid-containing bladder upon which said rigid platform is positioned, wherein said bladder is in the shape of a toroid having a diameter substantially less than the diameter of said disk-shaped platform such that said platform has a continuous overhang circumscribing the entirety of said bladder;

a valve in said bladder for adding or withdrawing fluid therefrom, wherein the stability of said bladder is increased by adding fluid thereto and the stability of said bladder is decreased by withdrawing fluid therefrom;

a pump in fluid communication with said bladder across said valve for adding fluid to said bladder;

a pressure control means in communication with said pump and said valve for the user to effect addition or withdrawal of fluid from said bladder while standing on the platform; and a diagnostic means for determining inclination of the platform as a function of time and correlating inclination data to the degree of kinesthetic impairment of the user.

2. The apparatus of claim 1 wherein the surface area of said rigid platform is greater than the area of contact between said rigid platform and said elastically deformable bladder.

3. The apparatus of claim 1 further comprising a rigid member oriented substantially perpendicular beneath said platform and abutting said platform at a pivot point to enable said platform to pivot on said rigid member.

4. The apparatus of claim 3 wherein said rigid member extends through a central opening of said toroid to abut said platform.

5. The apparatus of claim 4 wherein said rigid member is flexibly attached to said platform at the pivot point.

6. The apparatus of claim 3 further comprising a base beneath said bladder wherein said rigid member is fixably attached to said base.

7. The apparatus of claim 1 further comprising a stationary handrail positioned at a height greater than the rigid platform.

8. The apparatus of claim 1 wherein said diagnostic means is further for determining pressure variation in the bladder as a function of time and correlating pressure data to the degree of kinesthetic impairment of the user.

9. The apparatus of claim 8 wherein the diagnostic means comprises at least one inclinometer and a pressure transducer in electrical communication with a computer.

10. The apparatus of claim 1 wherein the diagnostic means comprises at least one inclinometer in electrical communication with a computer.

11. An apparatus for diagnosing and rehabilitating kinesthetic impairment comprising:

a rigid disk-shaped platform positioned upon an adjustable-stability fluid-containing bladder, said bladder having a toroid shape, aligned under said platform substantially concentrically with said platform, and having a diameter substantially less than the diameter of said disk-shaped platform such that said platform has a continuous overhang circumscribing the entirety of said bladder;

a valve enabling fluid addition and fluid withdrawal from said bladder, wherein the stability of said bladder is increased by adding fluid thereto and the stability of said bladder is decreased by withdrawing fluid therefrom;

a rigid pivot means extending substantially perpendicular to said platform through the central opening of said toroid-shaped bladder to flexibly engage said platform;

a base positioned beneath said bladder, said pivot means fixably mounted to said base;

a pump in fluid communication with said bladder across said valve for adding fluid to said bladder;

a pressure control means in communication with said pump and said valve for the user to effect addition or withdrawal of fluid from the bladder while standing on the platform; and a diagnostic means for determining inclination of the platform as a function of time and correlating inclination data to the degree of kinesthetic impairment of the user.

12. The apparatus of claim 11 wherein said diagnostic means is further for determining pressure variation in the bladder as a function of time while a user exercises on the platform and correlating pressure data to the degree of kinesthetic impairment of the user.

13. The apparatus of claim 12 wherein the diagnostic means comprises at least one inclinometer and a pressure transducer in electrical communication with a computer.

14. The apparatus of claim 11 wherein the diagnostic means comprises at least one inclinometer in electrical communication with a computer.

* * * * *